US006526734B1

(12) United States Patent
Huson et al.

(10) Patent No.: US 6,526,734 B1
(45) Date of Patent: Mar. 4, 2003

(54) PORTABLE PLASTIC FILM WRAPPING SYSTEM

(75) Inventors: Gale W. Huson, Glenview, IL (US); Hugh J. Zentmyer, Green Oaks, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/947,364

(22) Filed: Sep. 7, 2001

(51) Int. Cl.[7] ..... B65B 13/04
(52) U.S. Cl. ..... 53/588; 53/592; 53/390
(58) Field of Search ..... 53/556, 588, 582, 53/390

(56) References Cited

U.S. PATENT DOCUMENTS

| | | | | |
|---|---|---|---|---|
| 4,369,614 | A | | 1/1983 | Tetzner |
| D272,540 | S | | 2/1984 | Goldstein |
| 4,938,008 | A | | 7/1990 | Salzsauler |
| 5,296,079 | A | | 3/1994 | Romo |
| 5,398,884 | A | | 3/1995 | Stanford |
| 5,423,163 | A | | 6/1995 | Wendt |
| 5,458,841 | A | | 10/1995 | Shirrell |
| 5,561,971 | A | | 10/1996 | Sampson |
| 5,673,542 | A | | 10/1997 | Vartanian et al. |
| 5,779,179 | A | | 7/1998 | Zentmyer et al. |
| 6,170,233 | B1 | * | 1/2001 | Marois et al. ..... 53/588 |
| 6,237,307 | B1 | * | 5/2001 | Zentmyer et al. ..... 53/588 |
| 6,449,928 | B1 | * | 9/2002 | Huson ..... 53/566 |
| 6,470,657 | B2 | * | 10/2002 | Huson et al. ..... 53/588 |

OTHER PUBLICATIONS

Operators Manual, Model G–200, Low Profile Stretchwrap Machine, Manual Spiral Wrapper, Gerrard & Company, Apr., 1998.

* cited by examiner

*Primary Examiner*—John Sipos
(74) *Attorney, Agent, or Firm*—Schwartz & Weinrieb

(57) ABSTRACT

A portable plastic film wrapping system comprises a push-cart having a vertical mast member mounted thereon. A film roll carriage is vertically movable along the mast member, and the film roll carriage is operatively connected to a counterweight which is movably disposed within the mast member. The mast member is provided with a plurality of apertures, and a releasable stop pin is engageable within a particular one of the mast member apertures so as to lockingly retain the film roll carriage at a particular elevation when concentric reinforcing wrapping of an article is desired, and is disengageable from the apertures so as to permit the film roll carriage to continuously elevate for spiral wrapping of the article.

27 Claims, 4 Drawing Sheets

PORTABLE PLASTIC FILM WRAPPING SYSTEM

FIELD OF THE INVENTION

The present invention relates generally to plastic film wrapping apparatus for wrapping palletized loads or products, and more particularly to a new and improved plastic film wrapping apparatus or system which is truly portable, relatively simple in structure, and readily enables the manually controlled wrapping of palletized loads or products with plastic wrapping film.

BACKGROUND OF THE INVENTION

As has been noted within previously filed U.S. patent application Ser. No. 09/432,284, which was filed on Nov. 2, 1999 and in the name of Hugh J. Zentmyer et al. for an APPARATUS AND METHOD FOR MANUALLY APPLYING STRETCH FILM TO PALLETIZED PRODUCTS, it is a known fact that approximately fifty per-cent (50%) of all stretch film that is manufactured is applied to, for example, palletized loads or products by manual means. It is also known that when applying such stretch film to, for example, palletized loads or products, the manner in which such stretch film is manually applied to such loads or products usually comprises either one of two methods. In accordance with a first one of such manual methods, as illustrated, for example, within U.S. Pat. No. 5,398,884 which issued to Stanford on Mar. 21, 1995, the operator respectively inserts four fingers of each hand into each one of two oppositely disposed recessed portions defined within the film core end caps so as to effectively hold or grasp the film roll, and while placing his thumbs upon outside surface portions of the film roll, so as to effectively cause a predetermined amount of back tension to be applied to the film whereby the film is effectively stretched as the film is being unrolled or dispensed from the film roll, the operator walks around the palletized load or product. In accordance with a second one of such manual methods of applying a stretch film to such palletized loads or products, as illustrated, for example, within U.S. Pat. No. 5,458,841 which issued to Shirrell on Oct. 17, 1995, and in lieu of directly holding or grasping the film roll, the operator holds or grasps a film roll dispensing or holding device which has a built-in tensioning mechanism.

In accordance with either one of the aforenoted modes, methods, or manners in which stretch film is applied manually to the palletized products or loads, several operational disadvantages or drawbacks common to both methods or modes were apparent. Firstly, for example, the film roll, or the film roll and film roll dispensing or holding device, must be supported by the operator personnel, and yet the film roll and the film roll dispensing or holding device are quite heavy and cumbersome. In addition, in order to fully wrap a palletized load, the operator must bend down while holding the film roll, or the film roll and film roll dispensing or holding device, in order to wrap the film around the lower extremity portions of the palletized loads or products. Such requirements upon the operator personnel have been noted to cause acute discomfort, fatigue, and stress-related injuries. In addition, the operators experience fatigue and discomfort even when the operators are wrapping the upper regions of the palletized loads or products due to the continuous need for supporting the entire weight of the film roll, or the film roll and film roll dispensing or holding device.

A need therefore existed in the art for an apparatus, and for a method of operating the same, for overcoming the various operational disadvantages or drawbacks characteristic of the known PRIOR ART systems as briefly discussed hereinbefore and as disclosed within the aforenoted patents, and this need was substantially met by means of the apparatus or system, and the method of operating the same, which has been disclosed within the aforenoted U.S. patent application Ser. No. 09/432,284 and which has been quite commercially successful. However, while it has been noted in such aforenoted patent application that the apparatus or system disclosed within the aforenoted U.S. patent application Ser. No. 09/432,284 is portable in that the same is mounted upon a platform which has wheels, rollers, or the like so as to render the same movable or mobile, the apparatus is nevertheless relatively large and not readily transportable so as to, in turn, not be readily or easily movable within a particular wrapping plant or facility, or even yet further, readily or easily transportable between different wrapping plants or facilities located at different production sites.

Accordingly, the film wrapping apparatus or system disclosed within U.S. patent application Ser. No. 09/814,861 filed on Mar. 23, 2001 in the name of Gale W. Huson et al. for a PORTABLE FILM WRAPPING SYSTEM sought to overcome the various operational disadvantages of the known PRIOR ART and in fact successfully did do. Further improvements to such system were deemed necessary in order to render such system simpler in structure.

A need therefore exists in the art for a new and improved film wrapping apparatus wherein the film wrapping apparatus is truly portable, transportable, and simple in structure so as to readily enable the manual wrapping of palletized loads or products with wrapping film at a particular location within a production facility, at different locations within a particular production facility, or at different production facilities, and wherein the film wrapping apparatus is economical to produce.

OBJECTS OF THE INVENTION

Accordingly, it is an object of the present invention to provide a new and improved apparatus or system for applying wrapping film to palletized loads or products.

Another object of the present invention is to provide a new and improved apparatus or system for applying wrapping film to palletized loads or products wherein the various operational drawbacks and disadvantages, characteristic of PRIOR ART apparatus, systems, or methods of operating the same, are overcome.

An additional object of the present invention is to provide a new and improved apparatus or system for applying wrapping film to palletized loads or products wherein the wrapping film can be applied to or wrapped around the palletized loads or products by means of operator personnel who can simply walk around the pallet upon which the loads or products are disposed and simultaneously push or guide the roll of wrapping film around the palletized loads or products whereby the palletized loads or products are accordingly packaged or wrapped within such wrapping film.

A further object of the present invention is to provide a new and improved apparatus or system for applying packaging film to palletized loads or products wherein the packaging film can be applied to or wrapped around the entire vertical extent of the palletized loads or products by means of operator personnel who need not support the weight of the film roll, or the film roll and the film roll dispensing mechanism, and in addition need not bend down in order to wrap or apply the stretch film upon or to the lower extremity portions of the palletized loads or products.

A still yet further object of the present invention is to provide a new and improved apparatus or system for applying packaging film to palletized loads or products wherein the film wrapping apparatus or system is truly portable and transportable so as to readily enable the manual wrapping of palletized loads or products with wrapping film at a particular location within a production facility, at different locations within a particular production facility, or at different production facilities.

A last object of the present invention is to provide a new and improved apparatus or system for applying packaging film to palletized loads or products wherein the film wrapping apparatus or system is relatively simple in structure and economical to manufacture.

SUMMARY OF THE INVENTION

The foregoing and other objectives are achieved in accordance with the teachings and principles of the present invention through the provision of a new and improved apparatus or system, for applying packaging film to palletized loads or products disposed at a wrapping station or location, which comprises in effect, a manually movable cart which is formed by means of a chassis wherein a pair of relatively large non-pivotal or non-caster type wheels are mounted upon a rear end portion of the chassis, while a pair of relatively small pivotal or caster-type wheels are mounted upon a front end portion of the chassis so as to permit the cart to be steered. The chassis is also provided with a vertically upstanding mast member, and a film roll carriage, upon which a roll of plastic wrapping film is rotatably disposed so as to be capable of dispensing the plastic wrapping film therefrom, is movably mounted upon the mast member. A counterweight is operatively connected to the film roll carriage, through means of a suitable cable, so as to normally tend to elevate the film roll carriage and the roll of plastic wrapping film mounted thereon. The mast member is provided with a plurality of vertically spaced apertures, and the disposition of a spring-biased stop pin, with respect to the individual apertures, is able to be controlled by means of a manually-operated cable and lever mechanism.

More particularly, when the lever is squeezed, in a manner similar to that of a hand-operated brake lever upon a bicycle, the cable causes the stop pin to be released from a particular one of the apertures of the mast member whereby the film roll carriage, along with the roll of plastic wrapping film mounted thereon, will be elevated along the mast member so as to wrap the palletized load or product as the operator pushes the cart along a circular path around the palletized load or product. If continuous or concentric wrapping of the palletized load or product with the packaging film at a particular elevational level is desired, which is known as reinforcing wrapping, the lever is released so as to permit the stop pin to enter the next aperture located along the mast member. When the stop pin enters such aperture upon the mast member, further elevation of the film roll carriage, and the roll of wrapping film mounted thereon, is halted. At the completion of a wrapping cycle or operation, the operator needs to simply pull the film roll carriage downwardly by means of the stop pin housing, which has been effectively formed or structured as a manual handle, the stop pin will lock the film roll carriage at its lowermost position, and the apparatus is readied for a new palletized load or product wrapping cycle or operation.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
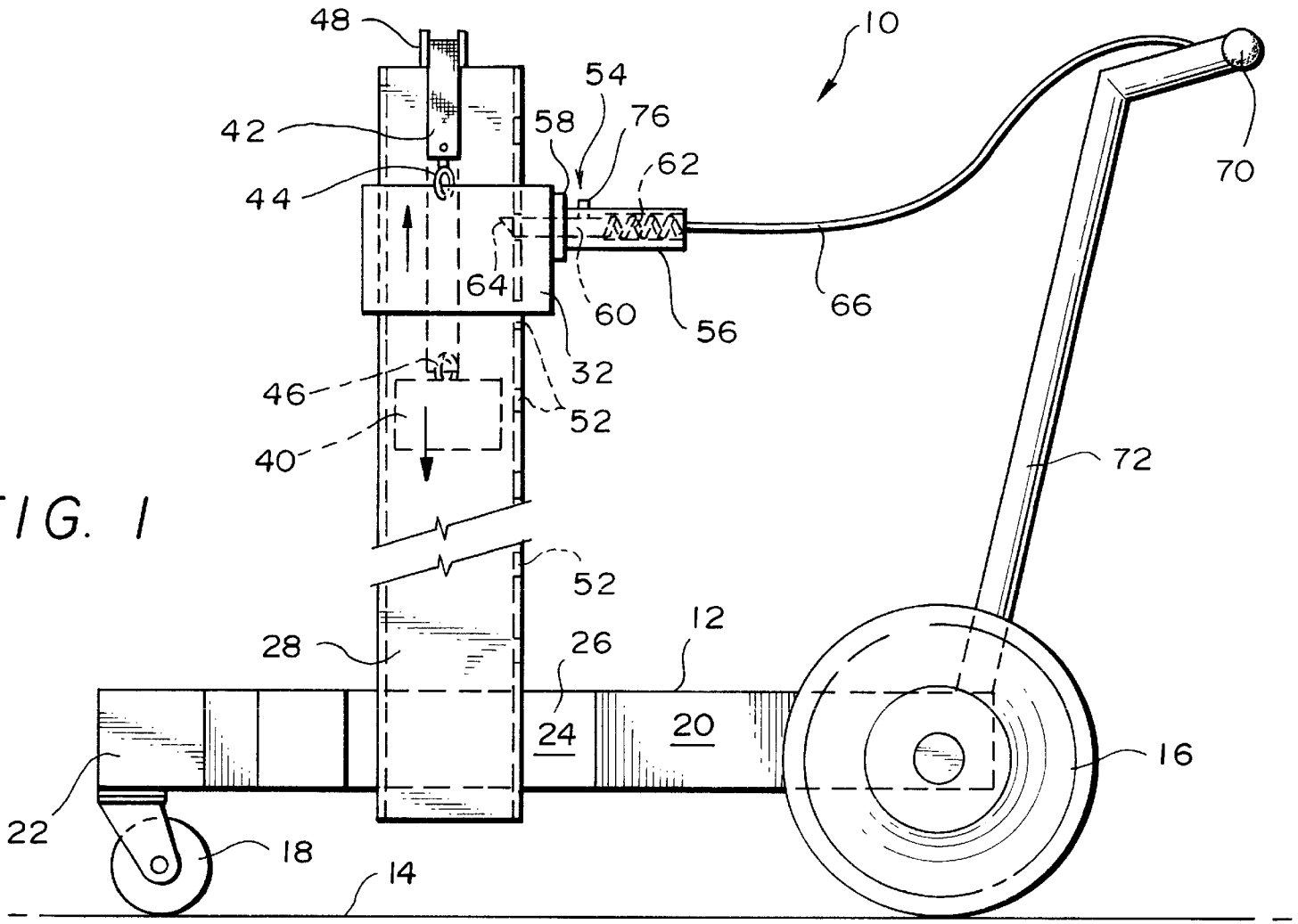
FIG. 1 is a side elevational view of a new and improved portable plastic film wrapping apparatus or system which has been constructed in accordance with the principles and teachings of the present invention and which shows the cooperative parts thereof for use in connection with the wrapping of palletized loads or products within plastic wrapping film.
Figure 2:
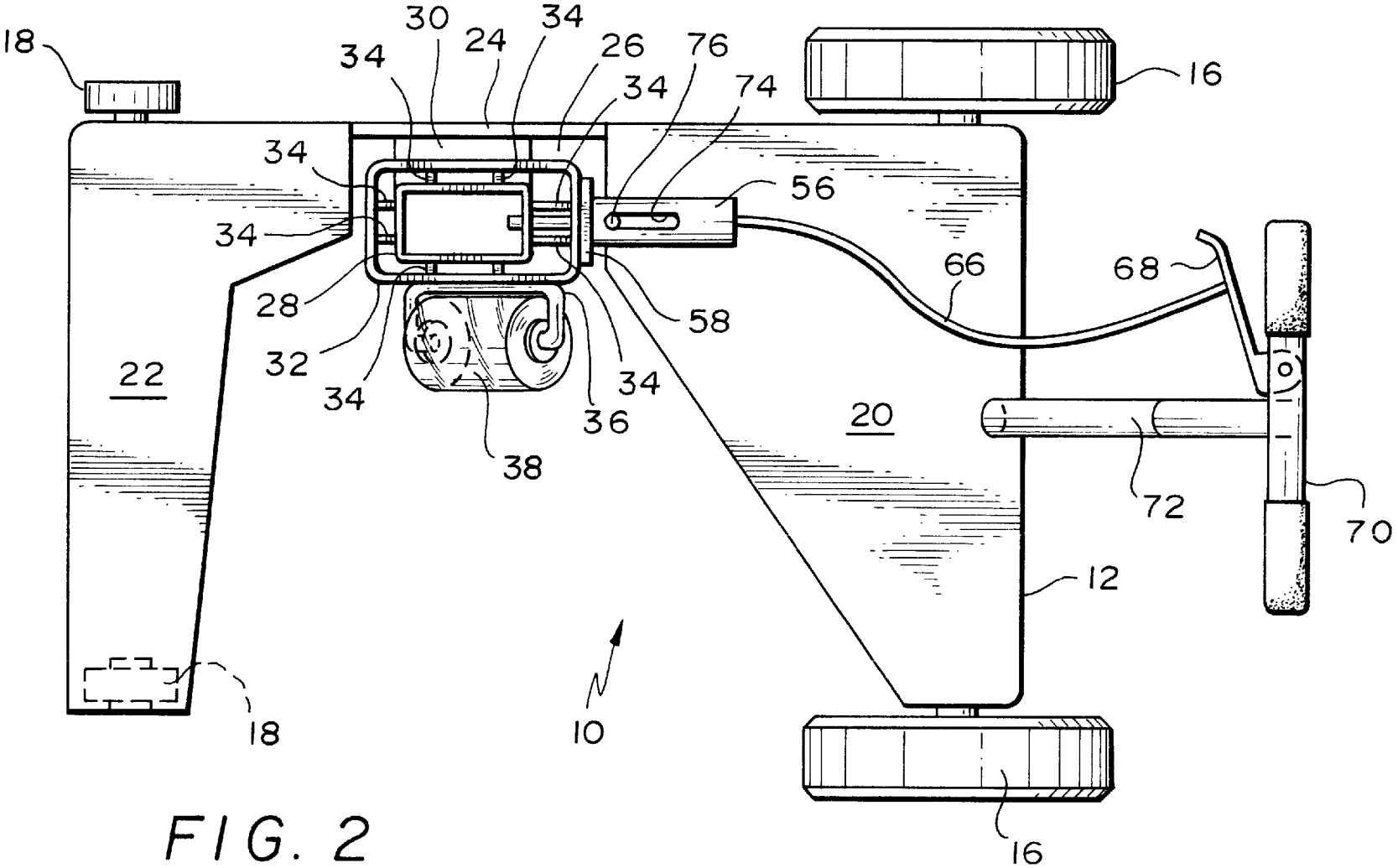
FIG. 2 is a top plan view of the new and improved portable plastic film wrapping apparatus or system as disclosed within FIG. 1.
Figure 3:
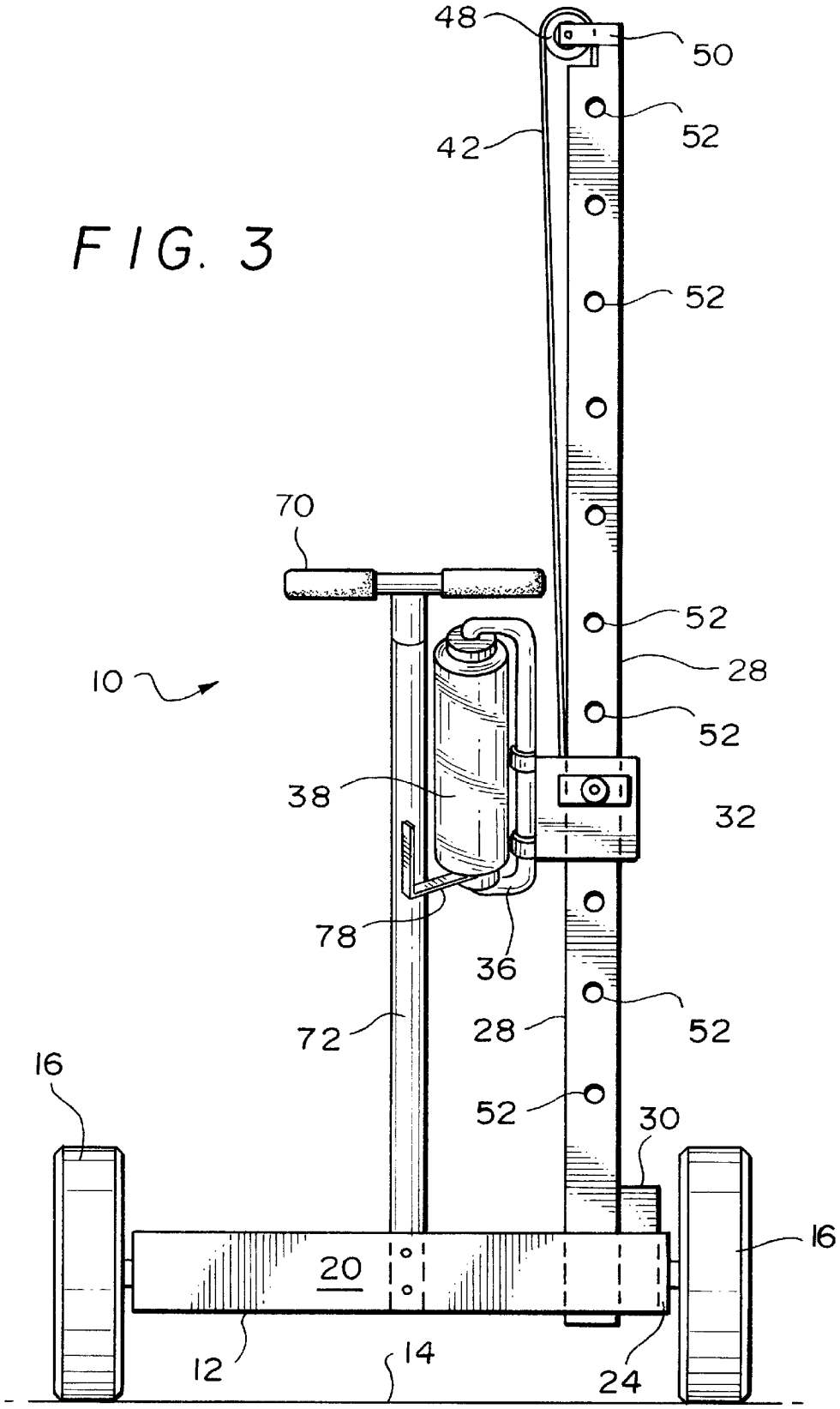
FIG. 3 is a rear elevational view of the new and improved portable plastic film wrapping apparatus or system as disclosed within FIGS. 1 and 2.

Referring now to the drawings, and more particularly to FIGS. 1–3 thereof, a new and improved portable plastic film wrapping apparatus or system, constructed in accordance with the principles and teachings of the present invention, is disclosed and is generally indicated by the reference character 10. The apparatus or system 10 is mounted upon a movable cart which renders the entire apparatus or system 10 portable and transportable, and it is seen that the movable cart comprises a chassis 12 which is adapted to be rollably supported and moved along a floor or ground region 14 by means of a pair of laterally or transversely spaced, non-pivotal rear wheels 16,16, and a pair of laterally or transversely spaced, pivotal or steerable front caster wheel assemblies 18,18. As best seen from FIG. 2, the chassis 12 substantially comprises a rear chassis section upon which the rear wheels 16,16 are rotatably mounted, and a front chassis section 22 upon which the front caster wheel assemblies 18,18 are mounted. The chassis 12 further includes a side frame member 24, and it is seen that the rear and front chassis sections 20,22 are separated from each other along side frame member 24 so as to effectively define a recessed region 26, between the chassis sections 20,22, within which the lower end portion of a vertically upstanding mast member 28 is adapted to be disposed. More particularly, as best seen in FIGS. 2 and 3, the lower end portion of the upstanding mast member 28 is adapted to be fixedly secured, for example, by means of suitable bolt fasteners, not shown, to a box-beam type support or mounting bracket 30, and the box-beam type support or mounting bracket 30 is, in turn, adapted to be fixedly secured, for example, by means of suitable bolt fasteners, also not shown, to the chassis side frame member 24.

The vertically upstanding mast member 28 comprises a hollow, box-beam structure having a substantially rectangular cross-sectional configuration, and a film roll carriage 32, also having a substantially hollow structure having a substantially rectangular cross-sectional configuration, is adapted to be movably disposed upon the upstanding mast member 28 in an annularly surrounding relationship. In order to readily facilitate the upward and downward movements of the film roll carriage 32 upon the external surfaces of the upstanding mast member 28, a plurality of NYLON® rollers 34 are rotatably mounted upon interior portions of the film roll carriage 32 so as to rollably engage the external surface portions of the upstanding mast member 28. The film roll carriage 32 of course has a film roll mounting and dispensing assembly 36 mounted thereon, and the film roll dispensing and mounting assembly 36 has a roll of wrapping film 38 removably mounted thereon as disclosed within FIGS. 2 and 3. The weight of the film roll carriage 32, the film roll mounting and dispensing assembly 36, and the roll of wrapping film 38 is adapted to be counterbalanced by means of a counterweight 40, which is actually slightly heavier than the combined weight of the noted components comprising the film roll carriage 32, the film roll mounting and dispensing assembly 36, and a full roll of wrapping film 38 including its core. It is noted that the counterweight 40 is adapted to be mounted internally within the hollow upstanding mast member 28, and the counterweight 40 may comprise either a solid block or a plurality of plates separably secured together. As best seen in FIGS. 1 and 3, the film roll carriage 32 is adapted to be operatively connected to the counterweight 40 by means of a NYLON® web belt 42 wherein the opposite ends of the belt 42 are respectively connected to the film roll carriage 32 and counterweight 40 by means of suitable releasable fasteners 44,46, and it is noted further that the web belt 42 is adapted to be routed over a pulley 48 which is rotatably mounted upon a suitable bracket 50 which is integral with the upper end portion of the mast member 28.

Continuing further, the mast member 28 is provided with a plurality of apertures 52 which are arranged within a vertically spaced array, and the film roll carriage 32 has fixedly mounted thereon, so as to be movable therewith, a stop pin assembly 54 which is adapted to operatively cooperate with the array or set of apertures 52 defined within the mast member 28 so as to fixedly retain the film roll carriage 32 at a particular elevational level along the mast member 28 as may be desired. More particularly, the stop pin assembly 54 is seen to comprise a stop pin housing 56 which includes a flanged portion 58 for enabling the stop pin assembly 54 to be bolted to the film roll carriage 32 by means of suitable fasteners, not shown, and a stop pin 60 is slidably movable within the stop pin housing 56 under the influence of a biasing spring 62. The forward or distal end or tip portion of the stop pin 60 is provided with an inclined or beveled face or surface 64, and in this manner, when the stop pin 60 is disposed in its forward and extended position under the biasing influence of the coil spring 62 such that the beveled tip portion 64 is disposed within one of the apertures 52 defined within the mast member 28, the film roll carriage 32 cannot be moved upwardly and is effectively locked at a predetermined elevational position with respect to the mast member 28. However, as will be discussed more fully hereinafter, the film roll carriage 32 can be optionally or desirably moved downwardly due to the fact that the beveled tip portion 64 of the stop pin 60 will permit the stop pin 60 to effectively self-release from the apertures 52 as the beveled tip portion 64 of the stop pin 60 successively encounters each one of the apertures 52 as a result of the film roll carriage 32 being moved downwardly relative to the mast member 28.

In order to in fact release the stop pin 60 from a particular one of the apertures 52 defined within the mast member 28, and thereby permit the film roll carriage 32 to be moved upwardly relative to and along the mast member 28, a first end of a release cable 66 is operatively connected to the stop pin 60 while a second opposite end of the release cable 66 is operatively connected to a release lever 68. The release lever 68 is pivotally mounted upon a horizontally disposed cross-bar or handle portion 70 which, in turn, is integrally fixed to an upper distal end portion of an upwardly extending, rearwardly inclined support bar 72. The lower end portion of the support bar 72 is fixedly attached to a rear deck portion of the rear chassis section 20, and it can therefore be readily appreciated that the upwardly extending inclined support bar 72 and the horizontally disposed cross-bar or handle 70 are similar in structure to corresponding structural components provided upon, for example, a conventional lawnmower. It can be readily appreciated still further that the release lever 68 is similar to, for example, a brake lever conventionally provided upon a bicycle, and accordingly, in a manner operatively similar to that employed in connection with such a bicycle brake lever, when the release lever 68 is squeezed or pivoted toward the cross-bar or handle 70, release cable 66 will cause stop pin 60 to be moved and retracted rearwardly against the biasing force of coil spring 62 such that the beveled tip portion 64 of the stop pin 60 is released from a particular one of the apertures 52 formed within the mast member 28.

It is also noted that should the release cable 66 break or otherwise become inoperative, the stop pin 60 can be manually released from a particular one of the apertures 52 defined within the mast member 28. More particularly, as best seen in FIG. 2, the upper surface of the stop pin housing 56 is provided with an elongated slot 74, and the upper surface of the stop pin 60 has a lug, button, or handle 76 integrally formed thereon and projecting vertically upwardly therefrom so as to extend through the slot 74. Accordingly, the button or handle 76 may be manually moved toward the right, as seen within FIGS. 1 and 2, within the slot 74 and against the biasing force of coil spring 62 so as to retract the stop pin 60 from its engaged position with respect to a particular one of the apertures 52 formed within the upstanding mast member 28.

Turning now to the operation of the new and improved plastic film wrapping apparatus or system 10 constructed in accordance with the principles and teachings of the present invention, when a plastic film wrapping cycle or operation is to be begin, the film roll carriage 32, having a roll of wrapping film 38 mounted thereon, is initially disposed at the lowermost position whereby the stop pin 60 will be at its spring-biased extended position so as to be lockingly engaged within the lowermost one of the plurality of apertures 52 defined within the mast member 28. It is noted, as may best be appreciated from FIG. 2, that the axis of the roll of wrapping film 38 is not in fact vertical but is disposed at a predetermined angle, and the reason for this is that such angular disposition of the wrapping film roll 38 enables the wrapping film to be dispensed therefrom at an orientation which facilitates the uniform spiral wrapping of the film upon the palletized load or product in a substantially flattened state. In addition, in order to properly initiate the wrapping of the palletized load or product within the wrapping film, it is usually desired to wrap the load or product within several layers at the lowermost level so as to reinforce and secure the load upon the pallet, or to provide the product with a firmly tightened or secured bottom region. Accordingly, a free end of the wrapping film is initially secured to the palletized load or product in any one of several conventional ways, and while the cart is being pushed around the load or product through several laps or revolutions, the film roll carriage 32 is maintained at its lowermost elevational level as a result of the stop pin 60 being maintained in the lowermost aperture 52 defined within the mast member 28.

Subsequently, when it is desired to begin upward movement of the film roll carriage 32 so as to cause elevation of the same and the wrapping of the upper levels of the palletized load or product within the wrapping film, the operator squeezes the release lever 68 which, through means of the release cable 66, causes the stop pin 60 to be withdrawn or retracted from the lowermost aperture 52 defined within the mast member 28. Since the film roll carriage 32, through means of the operatively associated stop pin 60, has now been effectively released from its locked position with respect to the mast member 28, the counterweight 40 is free to move downwardly thereby causing the film roll carriage 32 to be moved upwardly. It is to be noted that, as has been noted hereinbefore, the weight of the counterweight 40 is slightly greater than the combined weight of the film roll carriage 32, the film roll holder or mounting and dispensing assembly 36, and a full roll of wrapping film 38 including its core, however, the weight of the counterweight 40 must also overcome the frictional forces inherent within the roll of the wrapping film 38 tending to prevent the unwinding thereof, as well as the tension forces within the wrapping film. In other words, such frictional and tension forces are such that when the push cart is stationary and not being pushed, the oppositely acting weight forces characterized by the counterweight 40, and the film roll carriage assembly comprising the film roll carriage 32, the film roll holder or mounting and dispensing assembly 36, and a full roll of wrapping film 38 including its core, are balanced, whereby the counterweight 40 does not in fact descend and does not in turn cause the film roll carriage 32 to ascend. To the contrary, however, when the operator begins to push the cart along a circular route or path around the palletized load or product, incremental portions of the wrapping film are effectively and automatically continuously unwound from the roll of wrapping film 38 such that the aforenoted frictional forces are accordingly effectively and automatically continuously relieved or overcome. Therefore, the counterweight 40 is now in fact free to descend and cause the film roll carriage 32 to ascend thereby permitting the wrapping film being unwound and dispensed from the roll of wrapping film 38 to be wound around the palletized load or product in a spiral wrapped manner.

If desired, the foregoing wrapping mode of operation can be continuous whereby the entire vertical extent of the palletized load or product can be accordingly wrapped within the wrapping film. However, different types of wrapping modes are often desired to be performed in connection with the wrapping of a palletized load or product within plastic wrapping film. For example, reinforcing wrapping, comprising the application of a plurality of concentric layers of wrapping film at a predetermined elevational level, may be desired to be applied to and wrapped around the load or product, or different sections of the load or product may be desirably wrapped in wrapping film having predetermined amounts or degrees of overlap. In order to achieve reinforcing wrapping of the wrapping film upon the palletized load or product, the release lever 68 is simply released by the operator so as to no longer be disposed in its squeezed or activated state, and accordingly, the coil spring 62 will tend to bias the stop pin 60 toward its extended position. Consequently, as the film roll carriage 32 ascends, and the forward tip portion 64 of the stop pin 60 encounters the next aperture 52 defined within the mast member 28, the stop pin 60 will in effect snap into such aperture 52 and thereby lock the film roll carriage 32 at such elevational level. Therefore, as the push cart continues to be pushed or moved around the circular path or route wrapping film will be unwound from the wrapping film roll 38 and concentrically applied to the palletized load or product in its reinforcing mode. In order to terminate the reinforcing or concentric wrapping mode and against institute or achieve a spiral wrapping mode of the wrapping film, it is only necessary that the release lever 68 again be squeezed by the operator so as to withdraw or retract the stop pin 60 from the particular aperture 52 defined within the mast member 28 whereby the film roll carriage 32 will again be free to ascend.

It is to be noted that the vertical serial array of apertures 52 as defined within the mast member 28 have been provided at predetermined locations within the mast member 28, that is, adjacent apertures 52 are all vertically spaced apart through means of a vertical center-to-center distance of four and one-half inches (4.50"). Since the width of conventional wrapping film is eighteen inches (18.00"), the distance defined between each set of two adjacent apertures 52,52 comprises or equals one-quarter of the width of the wrapping film. Therefore, in accordance with another desirable mode of wrapping of the wrapping film upon the palletized load or product, if successive layers of the wrapping film are to be applied with a predetermined amount of overlap, the stop pin 60 can be lockingly disposed within a first one of the apertures 52 defined within the mast member 28, one or more layers of wrapping film material can then be wrapped around the load or product at that elevational level, the release lever 68 can then be briefly actuated and deactuated whereby the stop pin 60 will be retracted or withdrawn the particular aperture 52 defined within the mast member 28 and then be disposed within the next aperture 52 defined within the mast member 28 as film roll carriage 32 ascends along the mast member 28 so as to lockingly retain the film roll carriage 32 at the new elevational level, and the wrapping film can be wrapped around the load or product at the new elevational level.

Since the distance defined between adjacent apertures 52 defined within the mast member 28 equals one-quarter of the width of the wrapping film, then the sets of layers of the wrapping film are in effect separated or vertically offset from each other by twenty-five percent (25%) of the width of the wrapping film whereby the overlapped extent defined between such sets of film layers will be seventy-five percent (75%). In a similar manner, if the film roll carriage 32 is locked at a second mast aperture 52 which is spaced two apertures away from the original mast aperture 52, then the sets of layers of wrapping film are in effect separated or vertically offset from each other by fifty percent (50%) of the width of the wrapping film whereby the overlapped extent defined between such sets of film layers will likewise be fifty percent (50%), while if the film roll carriage 32 is locked at a second mast aperture 52 which is spaced three apertures away from the original mast aperture 52, then the sets of layers of wrapping film are in effect separated or vertically offset from each other by seventy-five percent (75%) of the width of the wrapping film whereby the overlapped extent defined between such sets of film layers will be twenty-five percent (25%).

Continuing further with the operation of the apparatus or system 10 for performing a palletized load or product wrapping cycle or operation, when the entire palletized load or product has been wrapped within the wrapping film as a result of the push cart having been walked around the palletized load or product while permitting the film roll carriage 32 to ascend to an elevational level which corresponds to the top of the load or product, movement of the push cart is terminated, and accordingly, the counterweight 40 and the film roll carriage 32 are now stationary as has been noted hereinbefore. Alternatively, if the height of the particular palletized load or product is such that the film roll carriage 32 needs to ascend to the top of the mast member 28 in order to complete the wrapping cycle or operation, the ascent of the film roll carriage 32 will be effectively arrested as a result of the counterweight 40 bottoming-out within the mast member 28. In either case, the operator may now manually move the film roll carriage 32 to its lowermost position simply by pulling downwardly, for example, upon the stop pin housing 56 which serves as a handle. Pulling downwardly upon the stop pin housing 56 exerts a force which is sufficient to overcome the weight force of the counterweight 40. Since the stop pin 60 is spring-biased by means of coil spring 62, and since the beveled tip portion 64 of the stop pin 60 is angled in the noted direction with respect to the apertures 52 defined within the mast member 28, pulling downwardly upon the stop pin housing 56 merely causes the stop pin 60 to be forced out of the particular upper aperture 52 of the mast member 28 within which the stop pin 60 might have been initially disposed at the termination of the wrapping cycle or operation if the film roll carriage 32 was actually disposed at a locked position or state. Subsequently, the stop pin 60 merely skips over the remaining aperture locations as the film roll carriage 32 is moved vertically downwardly as a result of the downward force being exerted upon the stop pin housing or handle 56.

Figure 5:
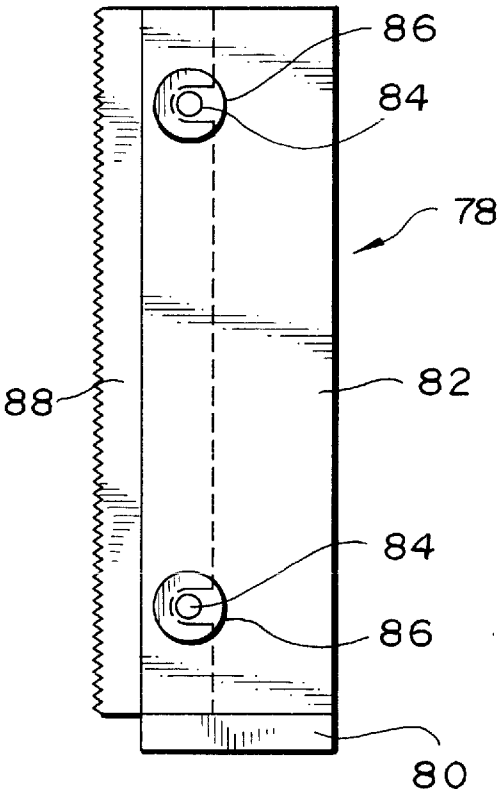
FIG. 5 is an end elevational view of the plastic film cutter blade mechanism as shown in FIG. 4.
Figure 4:
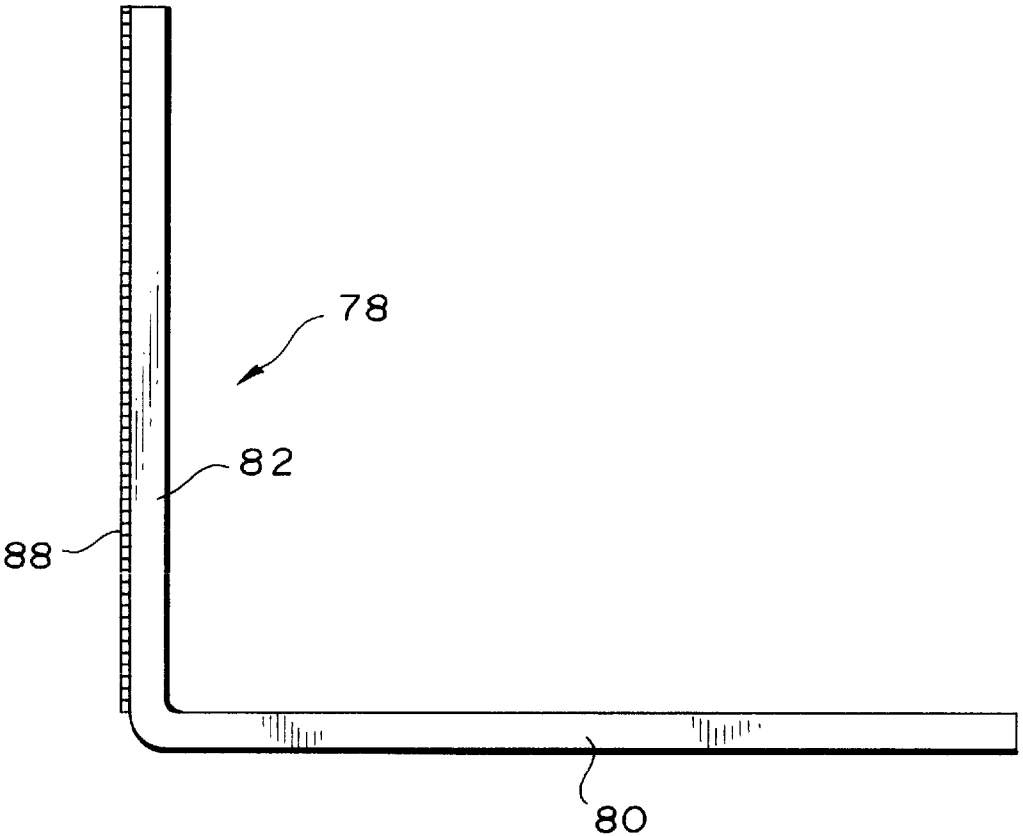
FIG. 4 is a side elevational detailed view showing the plastic film cutter blade mechanism of the present invention apparatus or system.

In order to fully complete a film wrapping cycle or operation, the film wrapping material disposed upon the roll of wrapping film 38 must obviously be separated from the film material just previously wrapped upon the palletized load or product. Accordingly, as best seen in FIG. 3, a cutter mechanism 78 is fixedly mounted upon the lower end portion of the film roll mounting and dispensing assembly 36 whereby, for example, at the conclusion of the film wrapping cycle or operation, and the lowering of the film roll carriage 32, the portion of the wrapping film adjacent to the roll of wrapping film 38 may be grasped, bunched together in a conventional manner, and moved across the cutter mechanism 78 so as to be severed. The severed end of the wrapping film which is integral with the wrapping film wrapped upon the palletized load or product may then of course be secured to the palletized load or product in a conventional manner, while the free end of the wrapping film extending away from the fresh supply of wrapping film wound upon the roll of wrapping film 38 may be readied for the next palletized load or product wrapping cycle or operation. The structural details of the cutter mechanism 78 are disclosed within FIGS. 4 and 5.

More particularly, it can be readily seen that the cutter mechanism 78 comprises an angle bracket which may be fabricated from aluminum, and it is seen that the cutter mechanism angle bracket comprises a horizontally disposed leg 80 and a vertically oriented leg 82. The horizontally disposed leg 80 may have a length of, for example, ten inches (10.00") while the vertical leg 82 may have a height dimension of, for example, eight inches (8.00"), and it is seen that the vertical leg 82 is provided with a pair of vertically spaced holes or apertures 84 through which suitable fasteners 86 are adapted to be disposed so as to fixedly secure or mount thereon a cutter blade element 88. The cutter blade element 88 may comprise a conventionally available band-saw blade having a substantially large number of extremely fine teeth incorporated therein such that the cutter blade element 88 is similar to cutting strips conventionally provided upon kitchen products such as, for example, SARAN WRAP® plastic film, REYNOLDS WRAP® aluminum foil, and the like. In this manner, by providing a cutting element such as cutting blade 88, efficient cutting of the plastic wrapping film is enabled and yet such cutting elements do not readily present safety hazards to operator personnel.

It is lastly noted in connection with particular film wrapping operations, while it is usually preferred that the wrapping mode proceed upwardly from the bottom of the load or product whereby successively applied wrapping layers are then disposed upon the load or product in an overlapped mode similar to the disposition of shingles upon a building roof so as to protect the load or product from exposure and weather conditions, it is sometimes desired to wrap the load or product in accordance with a wrapping mode which proceeds downwardly from the top of the load or product. In accordance with the principles and teachings of the present invention, and as afforded by means of the unique structural arrangement of the various components of the film wrapping apparatus or system 10 of the present invention, such an alternative mode of operation is readily able to be achieved. In order to in fact achieve such mode of operation, the flanged portion 58 of the stop pin housing 56 simply needs to be unbolted from the film roll carriage 32, effectively inverted 180°, and re-bolted to the film roll carriage 32. As a result of such new disposition or orientation of the stop pin housing 56 upon the film roll carriage 32, it will be appreciated that the stop pin 60 has likewise been effectively inverted 180° whereby the beveled tip portion 64 of the stop pin 60 is now disposed upwardly.

The counterweight web belt 42 is quickly and readily disconnected from the film roll carriage 32, and simply secured, for example, to another portion of the mast member 28 so as not to be dislodged from the pulley 48 or to be accidentally disposed within the hollow mast member 28, however, in view of the upward disposition of the beveled tip portion 64 of the stop pin 60 with respect to the apertures 52 defined within the mast member 28, the film roll carriage 32 will be maintained at a particular elevation along the mast member 28 and cannot move downwardly along or with respect to mast member 28 unless the stop pin 60 is firstly retracted or withdrawn from the particular aperture 52 of the mast member 28. Consequently, in order to achieve a film wrapping operation under this structural arrangement, the film roll carriage 32 is initially moved upwardly, the stop pin 60 effectively skipping over or bypassing the apertures 52 of the mast member 28 due to the upward orientation of the beveled tip portion 64 thereof, and when the film roll carriage 32 is disposed at the desired elevational level, the stop pin 60 will automatically snap into the adjacent aperture 52 defined within the mast member 28 thereby holding the film roll carriage 32 at that elevational level.

Subsequently, in order to permit the film roll carriage 32 to descend under its own weight, and as a result of the additional relief or release of the frictional forces normally present within the wrapping film but relieved or released as a result of the movement of the portable cart by the operator, as has been discussed hereinbefore, the stop pin 60 is withdrawn or retracted from the particular aperture 52 of the mast member 28 in response to movement of the same through means of the release cable 66, whereby, for example, the normal spiral wrapping operation can proceed. It can be further appreciated that the other wrapping modes of operation, which have been previously discussed in connection with the upwardly directed wrapping of a load or product, can likewise be achieved, and consequently, a detailed description of the same will be omitted herefrom in the interests of brevity.

Thus, it may be seen that in accordance with the principles and teachings of the present invention, a new and improved film wrapping apparatus or system has been developed which is extremely simple in structure, wherein the same is truly portable and transportable, and wherein further, the apparatus or system is readily capable of performing various different wrapping modes upon a palletized load or product, and in both upwardly and downwardly proceeding directions.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Portable apparatus adapted to be moved along a circular locus around an article disposed at a wrapping station so as to be capable of wrapping the article in wrapping film, comprising:

a manually movable portable push-cart;

a vertical mast member mounted upon said portable push-cart;

a film roll carriage vertically movable upon said vertical mast member;

a roll of wrapping film mounted upon said film roll carriage and adapted to have wrapping film, disposed upon said roll of wrapping film, operatively connected to the article disposed at the wrapping station during the performance of an article wrapping operation; and counterweight means operatively connected to said film roll carriage for descending and overcoming the weight of said film roll carriage and said roll of wrapping film mounted thereon, and thereby causing said film roll carriage and said roll of wrapping film mounted thereon to correspondingly ascend, as a result of said manually movable portable push-cart being moved along the circular locus around the article disposed at the wrapping station so as to relieve frictional and tension forces inherent within said wrapping film disposed upon said roll of wrapping film as well as within said wrapping film extending from said roll of wrapping film to the article being wrapped at the wrapping station and thereby cause said wrapping film to be unwound from said roll of wrapping film, so as to permit the article disposed at the wrapping station to be spirally wrapped within said wrapping film, and for being counterbalanced by said weight of said film roll carriage, said weight of said roll of wrapping film mounted thereon, and said frictional and tension forces inherent within said wrapping film disposed upon said roll of wrapping film as well as within said wrapping film extending from said roll of wrapping film to the article being wrapped at the wrapping station, as a result of the movement of said push-cart along the circular locus around the article disposed at the wrapping station being terminated so as to no longer relieve the frictional and tension forces inherent within said wrapping film disposed upon said roll of wrapping film as well as within said wrapping film extending from said roll of wrapping film to the article being wrapped at the wrapping station whereby the unwinding of said wrapping film from said roll of wrapping film is effectively prevented, such that said counterweight means can no longer descend and correspondingly cause said film roll carriage and said roll of wrapping film mounted thereon to ascend, said counterweight means thereby being maintained elevationally stationary so as to in turn maintain said film roll carriage elevationally stationary.

2. The apparatus as set forth in claim 1, further comprising:

a pulley member rotatably mounted upon said mast member; and a belt member disposed around said pulley member and having a first end portion thereof connected to said film roll carriage, and a second end portion thereof connected to said counterweight.

3. The apparatus as set forth in claim 1, further comprising:

a plurality of vertically spaced apertures defined within said mast member; and a stop pin operatively mounted upon said film roll carriage and movable between a first extended position at which said stop pin can operatively engage one of said plurality of vertically spaced apertures defined within said mast member so as to lockingly retain said film roll carriage at a particular elevational position with respect to said vertical mast member, and a second retracted position at which said stop pin is operatively disengaged from said plurality of vertically spaced apertures defined within said mast member so as to permit said film roll carriage to move freely along said vertical mast member.

4. The apparatus as set forth in claim 3, further comprising:

a stop pin housing within which said stop pin is movably disposed; and a spring member disposed within said stop pin housing and engaged with said stop pin for normally biasing said stop pin to said first extended position.

5. The apparatus as set forth in claim 4, further comprising:

a release lever operatively mounted upon said manually movable portable push-cart; and a release cable having a first end portion thereof operatively connected to said release lever and a second end portion thereof operatively connected to said stop pin, whereby when said release lever is actuated, said release cable will cause said stop pin to be moved from said first extended position to said second retracted position, whereas when said release lever is deactuated, said spring member will bias said stop pin from said second retracted position back to said first extended position.

6. The apparatus as set forth in claim 4, wherein:

said stop pin has a beveled tip portion engageable with said plurality of apertures defined within said mast member so as to lockingly prevent vertical movement of said film roll carriage in a first direction along said mast member when said stop pin is engaged within one of said apertures defined within said mast member, and for permitting movement of said film roll carriage in a second direction along said mast member even when said stop pin is initially engaged within one of said apertures defined within said mast member.

7. The apparatus as set forth in claim 4, wherein:

said stop pin has a beveled tip portion engageable with said plurality of apertures defined within said mast member for lockingly preventing vertical movement of said film roll carriage in an upward direction along said mast member when said stop pin is engaged within one of said apertures defined within said mast member so as to maintain said film roll carriage at a particular elevation whereby a concentric reinforcing wrapping mode can be achieved, and for permitting movement of said film roll carriage in a downward direction along said mast member even when said stop pin is initially engaged within one of said apertures defined within said mast member so as to permit said film roll carriage to be moved to a lowered position at which a film wrapping operation can be commenced.

8. The apparatus as set forth in claim 4, wherein:

said stop pin has a beveled tip portion engageable with said plurality of apertures defined within said mast member for lockingly preventing vertical movement of said film roll carriage in a downward direction along said mast member when said stop pin is engaged within one of said apertures defined within said mast member so as to maintain said film roll carriage at a particular elevation whereby a concentric reinforcing wrapping mode can be achieved, and for permitting movement of said film roll carriage in an upward direction along said mast member even when said stop pin is initially engaged within one of said apertures defined within said mast member so as to permit said film roll carriage to be moved to an elevated position at which a film wrapping operation can be commenced.

9. The apparatus as set forth in claim 6, wherein:

said stop pin housing is capable of being mounted upon said film roll carriage in either one of two different orientations 180° apart such that when said stop pin housing is mounted upon said film roll carriage within a first one of said two different orientation modes, said stop pin will lockingly prevent vertical movement of said film roll carriage in a first direction along said mast member when said stop pin is engaged within one of said apertures defined within said mast member, and will permit movement of said film roll carriage in a second direction along said mast member even when said stop pin is initially engaged within one of said apertures defined with-in said mast member, whereas when said stop pin housing is mounted upon said film roll carriage within a second one of said two different orientation modes, said stop pin will lockingly prevent vertical movement of said film roll carriage in said second direction along said mast member when said stop pin is engaged within one of said apertures defined within said mast member, and will permit movement of said film roll carriage in said first direction along said mast member even when said stop pin is initially engaged within one of said apertures defined within said mast member.

10. The apparatus as set forth in claim 5, wherein:

said stop pin has a manually operable handle fixedly mounted thereon and projecting out of said stop pin housing so as to be externally accessible for manually moving said stop pin to said second retracted position if said release cable should fail.

11. The apparatus as set forth in claim 1, wherein:

said roll of wrapping film is mounted upon said film roll carriage at a predetermined angle with respect to a vertical plane so as to facilitate spiral wrapping of the wrapping film upon the article.

12. The apparatus as set forth in claim 1, further comprising:

a film roll mounting and dispensing assembly mounted upon said film roll carriage and having said roll of wrapping film mounted thereon; and a cutter mechanism mounted upon said film roll mounting and dispensing assembly for severing said wrapping film at a point intermediate the article and said film roll carriage upon termination of a film wrapping operation.

13. The apparatus as set forth in claim 12, wherein:

said cutter mechanism comprises a band-saw blade element comprising a plurality of fine teeth which are able to readily cut said wrapping film and yet are not readily capable of cutting operator personnel.

14. The apparatus as set forth in claim 3, wherein:

said wrapping film has a width dimension of approximately eighteen inches (18.00"); and said plurality of apertures defined within said mast member are spaced four inches (4.00") apart, whereby when said stop pin is successively engaged within adjacent apertures defined within said mast member, concentrically wound layers of said wrapping film will exhibit an overlap of seventy-five percent (75%) of said wrapping film, whereas when said stop pin is successively engaged within apertures spaced apart by one aperture defined within said mast member, concentrically wound layers of said wrapping film will exhibit an overlap of fifty percent (50%) of said wrapping film, whereas when said stop pin is successively engaged within apertures spaced apart by two apertures defined within said mast member, concentrically wound layers of said wrapping film will exhibit an overlap of twenty-five percent (25%) of said wrapping film.

15. Portable apparatus adapted to be moved along a circular locus around an article disposed at a wrapping station so as to be capable of wrapping the article in wrapping film, comprising:

a manually movable portable push-cart;

a vertical mast member mounted upon said portable push-cart;

a plurality of vertically spaced apertures defined within said mast member;

a film roll carriage vertically movable upon said vertical mast member;

a roll of wrapping film mounted upon said film roll carriage and adapted to have wrapping film, disposed upon said roll of wrapping film, operatively connected to the article disposed at the wrapping station during the performance of an article wrapping operation;

a releasable mechanism operatively mounted upon said film roll carriage and movable between a first extended position at which said releasable mechanism can operatively engage one of said plurality of vertically spaced apertures defined within said mast member so as to lockingly retain said film roll carriage at a particular elevational position with respect to said vertical mast member, and a second retracted position at which said releasable mechanism is operatively disengaged from said plurality of vertically spaced apertures defined within said mast member so as to permit said film roll carriage to move freely along said vertical mast member; and counterweight means operatively connected to said film roll carriage for descending and overcoming the weight of said film roll carriage and said roll of wrapping film mounted thereon, and thereby causing said film roll carriage and said roll of wrapping film mounted thereon to correspondingly ascend, as a result of said manually movable portable push-cart being moved along the circular locus around the article disposed at the wrapping station so as to relieve frictional and tension forces inherent within said wrapping film disposed upon said roll of wrapping film as well as within said wrapping film extending from said roll of wrapping film to the article being wrapped at the wrapping station and thereby cause said wrapping film to be unwound from said roll of wrapping film, so as to permit the article disposed at the wrapping station to be spirally wrapped within said wrapping film, and for being counterbalanced by said weight of said film roll carriage, said weight of said roll of wrapping film mounted thereon, and said frictional and tension forces inherent within said wrapping film disposed upon said roll of wrapping film as well as within said wrapping film extending from said roll of wrapping film to the article being wrapped at the wrapping station, as a result of the movement of said push-cart along the circular locus around the article disposed at the wrapping station being terminated so as to no longer relieve the frictional and tension forces inherent within said wrapping film disposed upon said roll of wrapping film as well as within said wrapping film extending from said roll of wrapping film to the article being wrapped at the wrapping station whereby the unwinding of said wrapping film from said roll of wrapping film is effectively prevented, such that said counterweight means can no longer descend and correspondingly cause said film roll carriage and said roll of wrapping film mounted thereon to ascend, said counterweight means thereby being maintained elevationally stationary so as to in turn maintain said film roll carriage elevationally stationary.

16. The apparatus as set forth in claim 15, further comprising:

a pulley member rotatably mounted upon said mast member; and a belt member disposed around said pulley member and having a first end portion thereof connected to said film roll carriage, and a second end portion thereof connected to said counterweight.

17. The apparatus as set forth in claim 15, wherein:

said releasable mechanism comprises a stop pin;

a stop pin housing, within which said stop pin is movably disposed, is mounted upon said film roll carriage; and a spring member is disposed within said stop pin housing and engaged with said stop pin for normally biasing said stop pin to said first extended position.

18. The apparatus as set forth in claim 17, further comprising:

a release lever operatively mounted upon said manually movable portable push-cart; and a release cable having a first end portion thereof operatively connected to said release lever and a second end portion thereof operatively connected to said stop pin, whereby when said release lever is actuated, said release cable will cause said stop pin to be moved from said first extended position to said second retracted position, whereas when said release lever is deactuated, said spring member will bias said stop pin from said second retracted position back to said first extended position.

19. The apparatus as set forth in claim 17, wherein:

said stop pin has a beveled tip portion engageable with said plurality of apertures defined within said mast member so as to lockingly prevent vertical movement of said film roll carriage in a first direction along said mast member when said stop pin is engaged within one of said apertures defined within said mast member, and for permitting movement of said film roll carriage in a second direction along said mast member even when said stop pin is initially engaged within one of said apertures defined within said mast member.

20. The apparatus as set forth in claim 17, wherein:

said stop pin has a beveled tip portion engageable with said plurality of apertures defined within said mast member for lockingly preventing vertical movement of said film roll carriage in an upward direction along said mast member when said stop pin is engaged within one of said apertures defined within said mast member so as to maintain said film roll carriage at a particular elevation whereby a concentric reinforcing wrapping mode can be achieved, and for permitting movement of said film roll carriage in a downward direction along said mast member even when said stop pin is initially engaged within one of said apertures defined within said mast member so as to permit said film roll carriage to be moved to a lowered position at which a film wrapping operation can be commenced.

21. The apparatus as set forth in claim 17, wherein:

said stop pin has a beveled tip portion engageable with said plurality of apertures defined within said mast member for lockingly preventing vertical movement of said film roll carriage in a downward direction along said mast member when said stop pin is engaged within one of said apertures defined within said mast member so as to maintain said film roll carriage at a particular elevation whereby a concentric reinforcing wrapping mode can be achieved, and for permitting movement of said film roll carriage in an upward direction along said mast member even when said stop pin is initially engaged within one of said apertures defined within said mast member so as to permit said film roll carriage to be moved to an elevated position at which a film wrapping operation can be commenced.

22. The apparatus as set forth in claim 19, wherein:

said stop pin housing is capable of being mounted upon said film roll carriage in either one of two different orientations 180° apart such that when said stop pin housing is mounted upon said film roll carriage within a first one of said two different orientation modes, said stop pin will lockingly prevent vertical movement of said film roll carriage in a first direction along said mast member when said stop pin is engaged within one of said apertures defined within said mast member, and will permit movement of said film roll carriage in a second direction along said mast member even when said stop pin is initially engaged within one of said apertures defined with-in said mast member, whereas when said stop pin housing is mounted upon said film roll carriage within a second one of said two different orientation modes, said stop pin will lockingly prevent vertical movement of said film roll carriage in said second direction along said mast member when said stop pin is engaged within one of said apertures defined within said mast member, and will permit movement of said film roll carriage in said first direction along said mast member even when said stop pin is initially engaged within one of said apertures defined within said mast member.

23. The apparatus as set forth in claim 18, wherein:

said stop pin has a manually operable handle fixedly mounted thereon and projecting out of said stop pin housing so as to be externally accessible for manually moving said stop pin to said second retracted position if said release cable should fail.

24. The apparatus as set forth in claim 15, wherein:

said roll of wrapping film is mounted upon said film roll carriage at a predetermined angle with respect to a vertical plane so as to facilitate spiral wrapping of the wrapping film upon the article.

25. The apparatus as set forth in claim 15, further comprising:

a film roll mounting and dispensing assembly mounted upon said film roll carriage and having said roll of wrapping film mounted thereon; and a cutter mechanism mounted upon said film roll mounting and dispensing assembly for severing said wrapping film at a point intermediate the article and said film roll carriage upon termination of a film wrapping operation.

26. The apparatus as set forth in claim 25, wherein:

said cutter mechanism comprises a band-saw blade element comprising a plurality of fine teeth which are able to readily cut said wrapping film and yet are not readily capable of cutting operator personnel.

27. The apparatus as set forth in claim 17, wherein:

said wrapping film has a width dimension of approximately eighteen inches (18.00"); and said plurality of apertures defined within said mast member are spaced four inches (4.00") apart, whereby when said stop pin is successively engaged within adjacent apertures defined within said mast member, concentrically wound layers of said wrapping film will exhibit an overlap of seventy-five percent (75%) of said wrapping film, whereas when said stop pin is successively engaged within apertures spaced apart by one aperture defined within said mast member, concentrically wound layers of said wrapping film will exhibit an overlap of fifty percent (50%) of said wrapping film, whereas when said stop pin is successively engaged within apertures spaced apart by two apertures defined within said mast member, concentrically wound layers of said wrapping film will exhibit an overlap of twenty-five percent (25%) of said wrapping film.

* * * * *